US006429176B1

(12) United States Patent
Chen et al.

(10) Patent No.: US 6,429,176 B1
(45) Date of Patent: Aug. 6, 2002

(54) RAPIDLY EVAPORATING CLEANING COMPOSITIONS

(75) Inventors: Hang-Chang Bobby Chen, Getzville; Edward A. Rowe, Grand Island, both of NY (US)

(73) Assignee: Emerald Agrochemicals Company AVV, Parana (BR)

( * ) Notice: Subject to any disclaimer, the term of this patent is extended or adjusted under 35 U.S.C. 154(b) by 0 days.

(21) Appl. No.: 10/076,408

(22) Filed: Feb. 19, 2002

Related U.S. Application Data

(63) Continuation of application No. 08/644,144, filed on May 10, 1996, now abandoned.

(51) Int. Cl.[7] ..... C11D 7/30; C11D 7/60; C23G 5/032

(52) U.S. Cl. ..... 510/108; 510/175; 510/276; 510/285; 510/365; 510/412; 252/364

(58) Field of Search ..... 252/364; 510/175, 510/108, 176, 177, 200, 276, 285, 365, 371, 407, 408, 409, 410, 412, 411; 134/38, 40

(56) References Cited

U.S. PATENT DOCUMENTS

| | | | | |
|---|---|---|---|---|
| 3,546,304 A | | 12/1970 | Patron | |
| 4,232,072 A | | 11/1980 | Pardee | |
| 4,274,829 A | | 6/1981 | Zurbucher | |
| 4,578,209 A | | 3/1986 | Hisamoto et al. | |
| 5,244,507 A | | 9/1993 | Rowe | |
| 5,610,128 A | * | 3/1997 | Zyhowski et al. | 510/288 |

FOREIGN PATENT DOCUMENTS

| | | |
|---|---|---|
| WO | WO 94 28196 | 12/1994 |

* cited by examiner

*Primary Examiner*—Joseph D. Anthony
(74) *Attorney, Agent, or Firm*—Browdy and Neimark

(57) ABSTRACT

Disclosed is a composition of about 20 to about 80 wt % benzotrifluoride and about 20 to about 80 wt % trichloroethylene. Up to about 1 wt % of a stabilizer for the trichloroethylene can be included in the composition.

10 Claims, No Drawings

RAPIDLY EVAPORATING CLEANING COMPOSITIONS

This is a continuation of parent application Ser. No 08/644,144, which was filed on May 10, 1996 now abandoned.

This application is related to application Ser. No. 08/644,145 filed of even date by E. A. Rowe and H. C. Chen titled, "Improved Cleaning Composition Containing Benzotrifluoride," and to application Ser. No. 08/644,143, also filed of even date by E. A. Rowe and H. C. Chen, titled, "Cleaning Solvents Containing Benzotrifluoride and Fluorinated Compounds."

BACKGROUND OF THE INVENTION

This invention relates to a cleaning composition that has an unusually fast evaporation rate. In particular, it relates to a composition of benzotrifluoride and 1,1,2-trichloroethylene.

In manufacturing electronics, textiles, and apparel, it is necessary to remove grease, oil, and other soils left by machinery. A solvent that was widely used in industry for cleaning is 1, 1, 1-trichloroethane because it is non-flammable has a low odor, readily dissolves greases and oils, and has a rapid evaporation rate, which is important for high speed processing. However, 1,1,1-trichloroethane has now been banned because it has found to be an ozone depletor. As a result, there is a great need in the industry for a substitute solvent that has some or all of the desirable properties of 1,1,1-trichloroethane, but which is not an ozone depletor.

SUMMARY OF THE INVENTION

We have discovered that a blend of benzotrifluoride (BTF) and 1,1,2-trichloroethylene (TCE) is an excellent substitute solvent for 1,1,1-trichloroethane. This blend is economical, readily dissolves oils and greases, is non-flammable, and has only a slight ethereal odor, which is not regarded as objectionable.

Its most important and unusual property, however, is its high evaporation rate. Not only does this blend dry almost as rapidly as 1,1,1-trichloroethane, but, very unexpectedly, it dries faster than either of its components! That is, the evaporation rate of the blend is higher than the evaporation rate of either benzotrifluoride or 1,1,2-trichloroethylene. As of now we have no explanation for this unusual phenomenon.

DESCRIPTION OF THE PREFERRED EMBODIMENTS

The composition of this invention is a blend of about 20 to about 80 wt % benzotrifluoride and about 20 to about 80 wt % TCE. Preferably, the blend is about 60 to 80 wt % benzotrifluoride and about 20 to about 40 wt % TCE because TCE is the more regulated component.

The blend can also include various optional ingredients such as up to about 1 wt % of a stabilizer for the TCE. A stabilizer is preferably present at a concentration of about 0.01 to about 1 wt %. Examples of suitable stabilizers include butylene oxide, ethyl acetate, diisopropyl amine, and epichlorohydrin. The preferred stabilizer is butylene oxide because it stays with the solvent during distillation.

The composition of this invention is a single phase composition and remains a liquid from about −25° C. to about 86° C. It can be used to clean electronics, textiles, and for contact cleaning and general cleaning. In addition, it can also be used as a solvent carrier for powdered metals, as an ink carrier, or in gravure printing. It can be used as a liquid wash or as an aerosol. Other uses will no doubt be apparent to those skilled in the art.

The following examples further illustrate this invention.

EXAMPLE 1

(Evaporation Rate)

Benzotrifluoride (BTF) was mixed with TCE at various concentrations. The mixtures were tested for relative evaporation time using ASTM test D 1901-85. All tests were run in triplicates in a draft-free area. The following table summarizes the average evaporation rate with reference to butyl acetate (BuAc):

| Concentration of TCE in BTF (wt %) | Relative Evaporation Rate* (BuAc = 1) |
|---|---|
| 0 | 2.74 |
| 25 | 3.88 |
| 50 | 5.08 |
| 75 | 5.48 |
| 100 | 3.84 |

*"Dry Time" of BuAc divided by "Dry Time" of TCE in BTF

The above table shows that TCE concentrations of 25 to 75 wt % in BTF evaporate faster than either 100 wt % TCE or 100 wt % BTF.

EXAMPLE 2

(Cleaning)

The ability of various solvents to clean mineral oil was determined by weight difference. Approximately the same amounts, 30 mg, of mineral oil were brushed onto 7.6 by 1.3 cm (3 by ½ inch) steel coupons. The coated coupons were weighed and placed into 20 ml of a test solvent for 30 seconds, 2 minutes, and 4 minutes. No agitation was provided. The coupons were removed from the solvents, allowed to air dry for at least 30 minutes, and weighed again. The difference in weight measured the extent of cleaning. This test was repeated three times for each solvent and cleaning time combination. The traditional cleaning solvent, 1,1,1-trichloroethane (TCA), was also included for the comparison.

| | Weight % of Mineral Oil Left On Coupon | | |
|---|---|---|---|
| | TCA | BTF | 50/50 (By wt.) BTF/TCE |
| 30-second cleaning | 3.6 | 1.9 | 1.1 |
| 2-minute cleaning | 1.1 | 0.3 | 0.3 |
| 4-minute cleaning | 0.5 | 0.4 | 0.1 |

The above table shows that the 50/50 mixture of BTF/TCE was the superior cleaning solvent.

EXAMPLE 3

(Ink Dissolving Rate)

Pantone Reflex Blue ink paste was added at 2-gram increments to 20 grams of various solvents in a glass vial. After each addition, the mixtures were stirred, visually examined for miscibility, and the dissolving rates were recorded. The additions were continued until no more ink paste was soluble or until a total of 20 to 22 grams of the ink paste had been added to the solvent. The following table gives the solvents tested and the results.

| Solvent | Amounts of Ink Added (grams) | Ink Dissolving Rate |
|---|---|---|
| 50/50 (by wt.) BTF/TCE | 22.5 | Extremely Fast |
| Monochlorotoluene (MCT)[1] | 20.7 | Extremely Fast |
| Parachlorobenzotrifluoride (PCBTF)[2] | 20.5 | Very Fast |
| BTF | 20.3 | Very Fast |
| Aromatic hydrocarbon having a flashpoint of 38° C. (100° F.)[3] | 20.4 | Very Fast |
| 50/50 (by wt.) PCBTF/MCT | 20.1 | Fast |
| Toluene | 20.3 | Fast |
| Aromatic hydrocarbon having a flashpoint of 66° C. (150° F.)[4] | 4.6 | Rather Slow |
| 30/70 (by wt.) MCT/ aliphatic hydrocarbon having a flashpoint of 110° C.[5] | 10.4 | Rather Slow |
| Aliphatic hydrocarbon having a flashpoint of 110° C.[5] | 22.5 | Very Slow |

[1]Sold by Occidental Chemical Corporation as "OXSOL ® 10"
[2]Sold by Occidental Chemical Corporation as "OXSOL ® 100"
[3]Sold by Exxon as "Aromatic 100"
[4]Sold by Exxon as "Aromatic 150"
[5]Sold by Exxon as "Exxsol D 110"

The above table shows that BTF/TCE had the best ink dissolving rate of the solvents tested.

What is claimed is:

1. A single phase cleaning composition, in liquid form from about −25° C. to about 86° C., consisting essentially of a mixture of benzotrifluoride, 1,1,2-trichloroethylene, and a stabilizer for said 1,1,2-trichloroethylene, said mixture being substantially free of other components, said benzotrifluoride and said 1,1,2-trichloroethylene being present in a ratio wherein said composition dries faster than either benzotrifluoride by itself or 1,1,2-trichloroethylene by itself, said benzotrifluoride being present in said cleaning composition in an amount from about 60 wt % to about 80 wt % based on the total components of said cleaning composition, said 1,1,2-trichloroethylene being present in said cleaning composition in an amount of about 20 wt % to about 40 wt % based on the total components of said cleaning composition, and said stabilizer being present in said cleaning composition in an amount up to about 1 wt % based on the total components of said cleaning composition.

2. The cleaning composition of claim 1, wherein said stabilizer is present in an amount of about 0.01 to about 1 wt % based on said cleaning composition.

3. The cleaning composition of claim 1, wherein said stabilizer is selected from the group consisting of butylene oxide, ethyl acetate, diisopropyl amine and epichlorohydrin.

4. The cleaning composition of claim 3, wherein said stabilizer is butylene oxide.

5. The cleaning composition of claim 4, wherein said butylene oxide is present in an amount of about 0.01 to about 1 wt % based on said cleaning composition.

6. A single phase cleaning composition, in liquid form from about −25° C. to about 86° C., consisting of a mixture of benzotrifluoride, 1,1,2-trichloroethylene, and a stabilizer for said 1,1,2-trichloroethylene, said benzotrifluoride and said 1,1,2-trichloroethylene being present in a ratio wherein said composition dries faster than either benzotrifluoride by itself or 1,1,2-trichloroethylene by itself, said benzotrifluoride being present in said cleaning composition in an amount from about 25 wt % to about 75 wt % based on the total components of said cleaning composition, said 1,1,2-trichloroethylene being present in said cleaning composition in an amount of about 25 wt % to about 75 wt % based on the total components of said cleaning composition, and said stabilizer being present in said cleaning composition in an amount up to about 1 wt % based on the total components of said cleaning composition.

7. The cleaning composition of claim 6, wherein said stabilizer oxide is present in an amount of about 0.01 to about 1 wt % based on said cleaning composition .

8. The cleaning composition of claim 6, wherein said stabilizer is selected from the group consisting of butylene oxide, ethyl acetate, diisopropyl amine and epichlorohydrin.

9. The cleaning composition of claim 8, wherein said stabilizer is butylene oxide.

10. The cleaning composition of claim 8, wherein said butylene oxide is present in an amount of about 0.01 to about 1 wt % based on said cleaning composition.

* * * * *